US010016971B2

(12) United States Patent
Booth

(10) Patent No.: US 10,016,971 B2
(45) Date of Patent: Jul. 10, 2018

(54) PRINTING PRESS COMPRISING A MAGNETIC ORIENTATION UNIT AND A MOVABLE DRYING/CURING UNIT

(71) Applicant: KBA-NotaSys SA, Lausanne (CH)

(72) Inventor: Bradley Booth, Melbourne (AU)

(73) Assignee: KBA-NotaSys SA, Lausanne (CH)

( * ) Notice: Subject to any disclaimer, the term of this patent is extended or adjusted under 35 U.S.C. 154(b) by 0 days.

(21) Appl. No.: 15/520,273

(22) PCT Filed: Oct. 29, 2015

(86) PCT No.: PCT/IB2015/058362
§ 371 (c)(1),
(2) Date: Apr. 19, 2017

(87) PCT Pub. No.: WO2016/067247
PCT Pub. Date: May 6, 2016

(65) Prior Publication Data

US 2017/0326873 A1 Nov. 16, 2017

(30) Foreign Application Priority Data

Oct. 30, 2014 (EP) ..... 14191103

(51) Int. Cl.
*B41F 35/00* (2006.01)
*B41F 23/04* (2006.01)
(Continued)

(52) U.S. Cl.
CPC ..... *B41F 23/0409* (2013.01); *B41F 15/12* (2013.01); *B41F 23/0453* (2013.01);
(Continued)

(58) Field of Classification Search
CPC ..... B41F 23/0453
(Continued)

(56) References Cited

U.S. PATENT DOCUMENTS 2,306,607 A * 12/1942 Horton ..... B41F 23/0426 101/424.1
3,052,991 A * 9/1962 Goldner ..... D21F 7/003 34/114
(Continued)

FOREIGN PATENT DOCUMENTS

CH 706 783 11/2013
DE 1 126 127 3/1962
(Continued)

OTHER PUBLICATIONS

International Search Report and Written Opinion of the ISA for PCT/IB2015/058362, dated Feb. 22, 2016, 14 pages.

*Primary Examiner* — Anthony Nguyen
(74) *Attorney, Agent, or Firm* — Nixon & Vanderhye P.C.

(57) ABSTRACT

There is described a printing press (100) comprising a printing group (2) adapted to apply on a substrate at least one ink or varnish vehicle containing magnetic or magnetisable flakes and at least one magnetic orientation unit (10) located downstream of the printing group (2) along a path of the substrate, which magnetic orientation unit (10) includes at least one magnetic-field-inducing device (12) adapted to orient the magnetic or magnetisable flakes contained in the ink or varnish vehicle applied on the substrate to induce an optically-variable effect in the ink or varnish vehicle. The printing press (100) further comprises a drying/curing unit (15) located along the path of the substrate and cooperating with the magnetic orientation unit (10), which drying/curing unit (15) is adapted to dry or cure the ink or varnish vehicle applied on the substrate following orientation of the magnetic or magnetisable flakes. The drying/curing unit (15) is mounted on a movable supporting structure (16) that is adapted to move the drying/curing unit (15) between a working position (WP), where the drying/curing unit (15) is cooperating with the magnetic orientation unit (10) and
(Continued)

which is located proximate to the path of the substrate next to the magnetic orientation unit (10), and a retracted position (RP), where the drying/curing unit (15) is retracted away from the magnetic orientation unit (10) and from the path of the substrate.

19 Claims, 6 Drawing Sheets

(51) Int. Cl.
*B41F 15/12* (2006.01)
*B41F 13/00* (2006.01)
*B41F 19/00* (2006.01)

(52) U.S. Cl.
CPC ..... *B41F 23/0483* (2013.01); *B41F 13/0024* (2013.01); *B41F 19/005* (2013.01); *B41P 2213/804* (2013.01)

(58) Field of Classification Search
USPC ..... 101/424.1
See application file for complete search history.

(56) References Cited

U.S. PATENT DOCUMENTS

| | | | | |
|---|---|---|---|---|
| 4,646,446 | A | 3/1987 | Bubley | |
| 5,832,833 | A | 11/1998 | Burgio | |
| 6,984,830 | B2 | 1/2006 | Burgio | |
| 8,186,272 | B2 * | 5/2012 | Reichelsheimer | B41F 23/044 101/484 |
| 8,286,551 | B2 | 10/2012 | Gygi | |
| 8,499,687 | B2 | 8/2013 | Gygy et al. | |
| 8,621,997 | B2 | 1/2014 | Gygi | |
| 8,813,644 | B2 | 8/2014 | Gygi et al. | |
| 9,156,245 | B2 | 10/2015 | Eitel et al. | |
| 9,387,667 | B2 | 7/2016 | Eitel et al. | |
| 2002/0190225 | A1 | 12/2002 | Burgio | |
| 2005/0087086 | A1 * | 4/2005 | Jung | B41F 23/044 101/424.1 |
| 2006/0219107 | A1 | 10/2006 | Gygi | |
| 2010/0170408 | A1 | 7/2010 | Gygi et al. | |
| 2011/0017081 | A1 | 1/2011 | Gygi | |
| 2011/0250001 | A1 | 10/2011 | Eitel et al. | |
| 2012/0133716 | A1 * | 5/2012 | Aizawa | B41F 23/0409 347/102 |
| 2013/0298791 | A1 | 11/2013 | Gygi et al. | |
| 2014/0218502 | A1 | 8/2014 | Schaede et al. | |
| 2015/0231877 | A1 | 8/2015 | Eitel et al. | |

FOREIGN PATENT DOCUMENTS

| | | |
|---|---|---|
| DE | 39 02 643 | 12/1990 |
| DE | 100 47 078 | 4/2002 |
| DE | 10 2004 021 141 | 8/2005 |
| DE | 10 2006 043 789 | 3/2008 |
| EP | 0 223 490 | 5/1987 |
| EP | 2 399 745 | 12/2011 |
| EP | 2 433 798 | 3/2012 |
| GB | 744343 | 2/1956 |
| GB | 2 512 238 | 9/2014 |
| WO | WO 97/04962 | 2/1997 |
| WO | WO 02/101290 | 12/2002 |
| WO | WO 2005/000585 | 1/2005 |
| WO | WO 2008/102303 | 8/2008 |
| WO | WO 2009/156926 | 12/2009 |

* cited by examiner

PRINTING PRESS COMPRISING A MAGNETIC ORIENTATION UNIT AND A MOVABLE DRYING/CURING UNIT

This application is the U.S. national phase of International Application No. PCT/IB2015/058362 filed 29 Oct. 2015, which designated the U.S. and claims priority to EP Patent Application No. 14191103.2 filed 30 Oct. 2014, the entire contents of each of which are hereby incorporated by reference.

TECHNICAL FIELD

The present invention generally relates to a printing press comprising a magnetic orientation unit.

More precisely, the invention relates to such a printing press that comprises a printing group adapted to apply on a substrate at least one ink or varnish vehicle containing magnetic or magnetisable flakes and at least one magnetic orientation unit located downstream of the printing group along a path of the substrate, which magnetic orientation unit includes at least one magnetic-field-inducing device adapted to orient the magnetic or magnetisable flakes contained in the ink or varnish vehicle applied on the substrate to induce an optically-variable effect in the ink or varnish vehicle, wherein the printing press further comprises a drying/curing unit located along the path of the substrate and cooperating with the magnetic orientation unit, which drying/curing unit is adapted to dry or cure the ink or varnish vehicle applied on the substrate following orientation of the magnetic or magnetisable flakes.

BACKGROUND OF THE INVENTION

Such printing presses are known as such in the art, in particular from International PCT Publications Nos. WO 2005/000585 A1, WO 2008/102303 A2, WO 2009/156926 A2 and European Patent Publication No. EP 2 433 798 A1, which publications are all incorporated herein by reference in their entirety.

European Patent Publication No. EP 2 433 798 A1 in particular discloses a sheet-fed printing press 100 as schematically illustrated in FIG. 1, which printing press 100 comprises a silk-screen printing group 2 adapted to apply at least one ink or varnish vehicle containing magnetic or magnetisable flakes on a sheet-like substrate. Individual substrates are fed in succession from a sheet feeder station 1 to the silk-screen printing group 2, which silk-screen printing group 2 includes first and second screen printing units 2*b*, 2*c* cooperating with a common impression cylinder 2*a*. In the illustrated example, an upper side of each substrate (indicated by the white triangles in FIG. 1) is thus provided with one or more patterns of an ink or varnish vehicle containing the magnetic or magnetisable flakes and the thus-printed substrates are then transported in succession from the printing group 2 to a downstream-located magnetic orientation unit 10 which is positioned along the path of the substrate and is designed to induce an optically-variable effect in the ink or varnish vehicle prior to drying/curing thereof. This optically-variable effect is induced by means of the magnetic orientation unit 10 which includes at least one magnetic-field-inducing device adapted to orient the magnetic or magnetisable flakes contained in the ink or varnish vehicle applied on the substrate. Advantageously, the magnetic orientation unit 10 is of a type comprising a rotating cylinder assembly 11 (see also International PCT Publication No. WO 2008/102303 A2 already cited hereinabove).

As shown in FIG. 1, the substrates are preferably transported from the printing group 2 to the magnetic orientation unit 10 by means of a first conveyor system 21 (the rotating cylinder assembly 11 also acting as transport cylinder in such example) and then from the magnetic orientation unit 10 to a second conveyor system 22 which transports the substrates onwards, e.g. to a sheet delivery station 4.

As taught by European Patent Publication No. EP 2 433 798 A1, a drying/curing unit 15 is provided proximate to where the rotating cylinder assembly 11 is located. A further drying/curing unit 5 may be provided downstream of the magnetic orientation unit (e.g. along the path of the second conveyor system 22) in order to finalise drying/curing of the ink or varnish vehicle applied on the substrate.

A drawback of the known solutions as for instance taught by European Patent Publication No. EP 2 433 798 A1 resides in the fact that the provision of the additional drying/curing unit compromises accessibility to the magnetic orientation unit.

Furthermore, maintenance operations on both the drying/curing unit and the magnetic orientation unit are made more difficult.

There is therefore a need for an improved solution.

SUMMARY OF THE INVENTION

A general aim of the invention is to improve the known printing presses of the aforementioned type.

More precisely, an aim of the present invention is to provide such a printing press where accessibility to the drying/curing unit and to the associated magnetic orientation unit is improved.

Another aim of the present invention is to provide such a printing press where maintenance operations on the drying/curing unit and the associated magnetic orientation unit are facilitated.

These aims are achieved thanks to the printing press defined in the claims. In particular there is provided a printing press comprising a printing group adapted to apply on a substrate at least one ink or varnish vehicle containing magnetic or magnetisable flakes and at least one magnetic orientation unit located downstream of the printing group along a path of the substrate, which magnetic orientation unit includes at least one magnetic-field-inducing device adapted to orient the magnetic or magnetisable flakes contained in the ink or varnish vehicle applied on the substrate to induce an optically-variable effect in the ink or varnish vehicle. The printing press further comprises a drying/curing unit located along the path of the substrate and cooperating with the magnetic orientation unit, which drying/curing unit is adapted to dry or cure the ink or varnish vehicle applied on the substrate following orientation of the magnetic or magnetisable flakes. According to the invention, the drying/curing unit is mounted on a movable supporting structure that is adapted to move the drying/curing unit between a working position, where the drying/curing unit is cooperating with the magnetic orientation unit and is located proximate to the path of the substrate next to the magnetic orientation unit, and a retracted position, where the drying/curing unit is retracted away from the magnetic orientation unit and from the path of the substrate.

In accordance with a preferred embodiment of the invention, the magnetic orientation unit comprises a rotating cylinder assembly carrying the said at least one magnetic-field-inducing device on an outer circumference of the rotating cylinder assembly, the substrate being brought in contact to or in close proximity with the rotating cylinder assembly over a defined angular sector, and the drying/curing unit is located proximate to the outer circumference of the rotating cylinder assembly, in the working position of the drying/curing unit, at a downstream end of the angular sector. In this context, the printing press may advantageously comprise a first conveyor system to convey the substrate from the printing group to the magnetic orientation unit and a second conveyor system to convey the substrate from the magnetic orientation unit onwards.

In accordance with an advantageous variant of the aforementioned preferred embodiment, where the printing press is a sheet-fed printing press, the substrate is transferred from the first conveyor system to the magnetic orientation unit and from the magnetic orientation unit to the second conveyor system, the rotating cylinder assembly of the magnetic orientation unit acting as sheet transfer cylinder transporting the substrate over the defined angular sector. The first and second conveyor systems are preferably chain conveyor systems with endless chains driving a plurality of spaced-apart gripper bars, which gripper bars are designed to hold a leading edge of the substrate.

In accordance with another embodiment of the invention, the rotating cylinder assembly is advantageously removable from the printing press and the movable supporting structure is designed to move the drying/curing unit to the retracted position in such a way as to free a path to remove the rotating cylinder assembly from the printing press, the rotating cylinder assembly being preferably removable from the printing press by lifting.

In accordance with yet another embodiment of the invention, the rotating cylinder assembly is located below a floor section of the printing press and the ink or varnish vehicle is applied onto an upper side of the substrate. Furthermore, the rotating cylinder assembly is located below the path of the substrate, under the floor section, while the drying/curing unit is located above the path of the substrate. In addition, the movable supporting structure is advantageously designed to move the drying/curing unit from the working position, below the floor section, to the retracted position, above the floor section. In this particular context, the printing press may further comprise a removable cover panel that covers the movable supporting structure and the drying/curing unit, when the drying/curing unit is in the working position, and forms a portion of the floor section. This removable cover panel can advantageously be supported onto the floor section and be designed to be movable with respect to the floor section between a closed position, where the removable cover panel covers the movable supporting structure, and the drying/curing unit, when the drying/curing unit is in the working position, and forms the portion of the floor section, and an open position, where the removable cover panel is moved with respect to the floor section to create an opening in the floor section through which the movable supporting structure can be moved. In that respect, the removable cover panel is preferably movable separately from the movable supporting structure.

The movable supporting structure of the invention may advantageously be designed as a pivotable arm system.

Furthermore, the drying/curing unit may in particular be a UV curing unit, preferably a UV-LED curing unit.

In accordance with yet another embodiment of the invention, the drying/curing unit preferably comprises a plurality of drying/curing heads supported by the movable supporting structure and which are distributed transversally to the path of the substrate. These drying/curing heads can advantageously be supported onto a guide rail, which guide rail is secured to and movable together with the movable supporting structure, a position of each drying/curing head along the guide rail being adjustable.

In accordance with still another embodiment of the invention, the supporting structure further supports cooling and power supply ports to which the drying/curing unit is coupled.

In accordance with a further refinement of the invention, the printing press may further comprise a camera to capture live images of the transport of the substrate past the magnetic orientation unit.

The printing press of the invention can in particular be a silk-screen printing press, the invention being however applicable to any other suitable type of printing press, such as an intaglio printing press.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of a sheet-fed silk-screen printing press comprising at least one magnetic orientation unit as discussed in the preamble part hereof. It should however be appreciated that the present invention is applicable irrespective of the type of printing press and printing process being carried out to apply the at least one ink or varnish vehicle containing magnetic or magnetisable flakes. Silk-screen printing is however a preferred printing process in the context of the present invention. Furthermore, while the invention is particularly suitable for application in a sheet-fed printing press, it can also be applied to web-fed printing presses if necessary.

Figure 1:
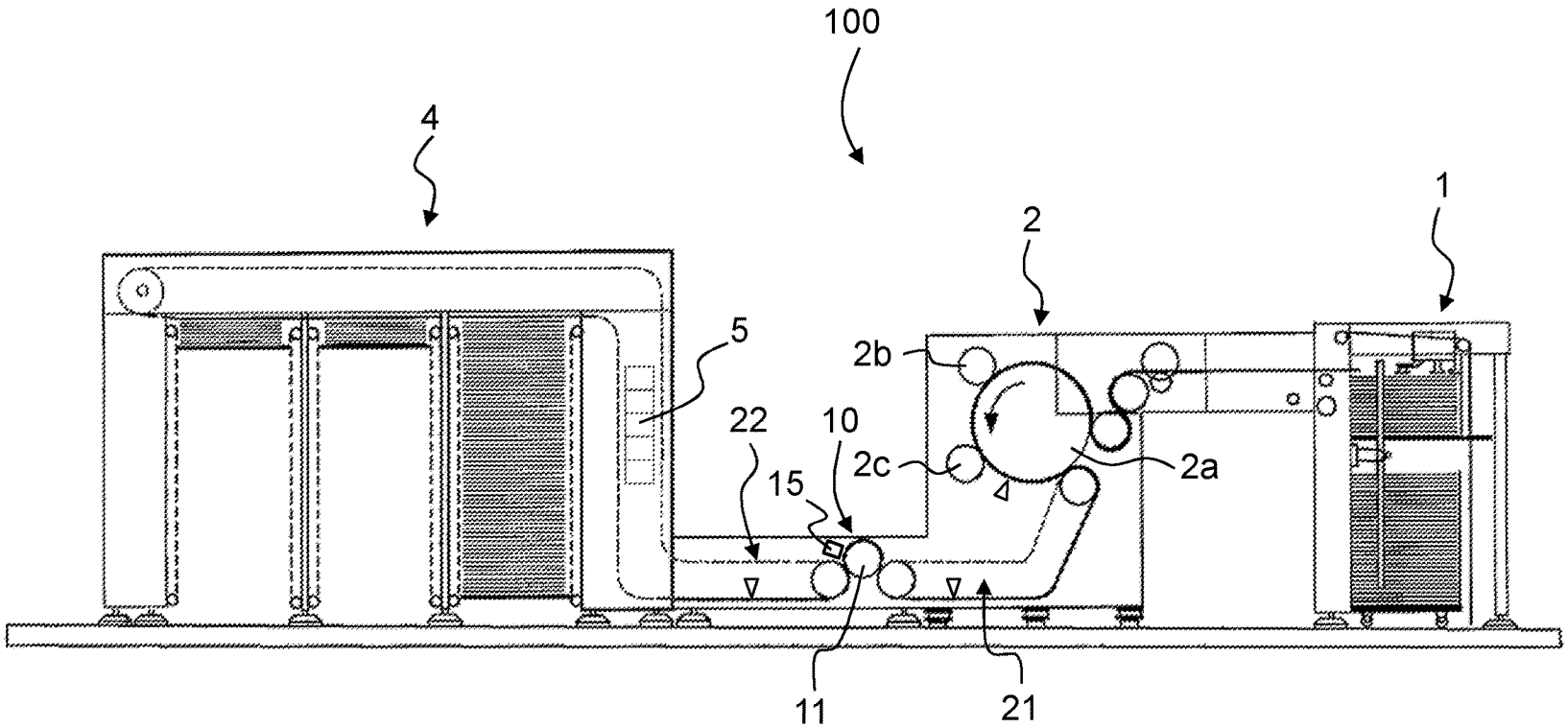
Fig. 1 (PRIOR ART)
FIG. 1 is schematic illustration of a known printing press as for instance disclosed in European Patent Publication No. EP 2 433 798 A1.
Figure 2:
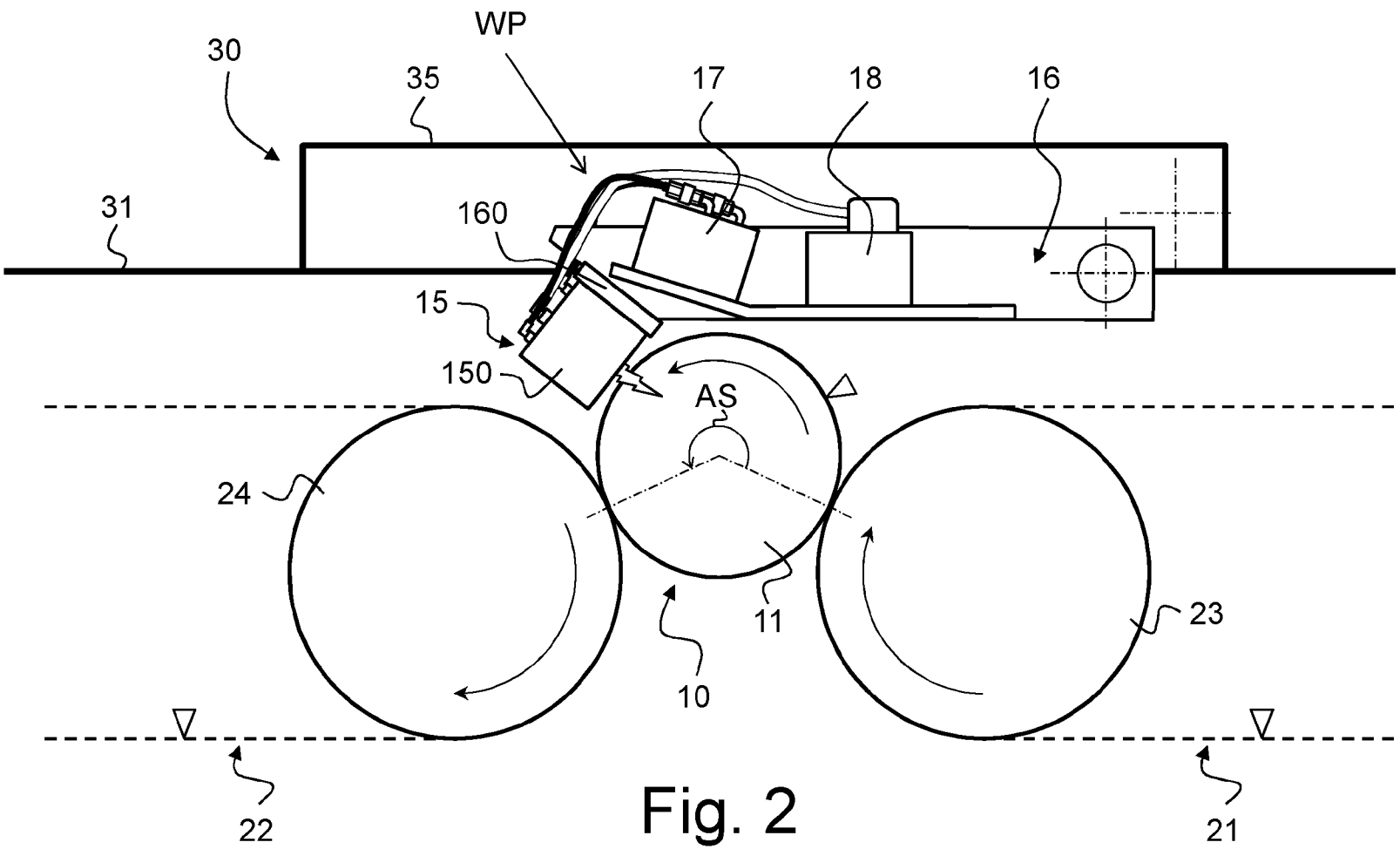
FIG. 2 is a schematic partial side view of a portion of a printing press showing the location of the magnetic orientation unit and drying/curing unit of the printing press in accordance with a preferred embodiment of the invention.

A preferred embodiment of the invention will be described with reference to FIGS. 2 to 6, it being to be understood that this embodiment is based on a sheet-fed silk-screen printing press 100 as generally discussed with reference to FIG. 1. In other words, in accordance with this preferred embodiment of the invention, the magnetic orientation unit 10 preferably comprises a rotating cylinder assembly 11 carrying at least one magnetic-field-inducing device 12 (visible in FIG. 3) on an outer circumference of the rotating cylinder assembly 11. As shown in FIG. 2, the substrate onto which the at least one ink or varnish vehicle containing magnetic or magnetisable flakes has been applied by the printing group 2 (namely on the upper side of the printed sheets as indicated by the white triangles) is brought in contact to (or, as the case may be, in close proximity with) the rotating cylinder assembly 11 over a defined angular sector AS.

The substrates (i.e. the individual sheets) are conveyed from the printing group 2 of the printing press 100 to the magnetic orientation unit 10 by means of a first conveyor 21, a second conveyor 22 being provided to convey the substrates from the magnetic orientation unit 10 onwards, namely to the sheet delivery station 4 in this example. More precisely, the rotating cylinder assembly 11 acts in this case as a sheet transfer cylinder transporting the substrate over the defined angular sector AS, the first and second conveyor systems 21, 22 being preferably chain conveyor systems with endless chains driving a plurality of spaced-apart gripper bars (not shown), which gripper bars are designed to hold a leading edge of each substrate. FIG. 2 shows that a pair of chain wheels 23 of the first conveyor 21 (namely the pair of chain wheels which are located at the downstream end of the first conveyor 21) cooperate with the rotating cylinder assembly 11 to ensure transfer of the individual sheets from the first conveyor 21 to the rotating cylinder assembly 11. FIG. 2 likewise shows that a pair of chain wheels 24 of the second conveyor 22 (namely the pair of chain wheels which are located at the upstream end of the second conveyor 22) also cooperate with the rotating cylinder assembly 11 to ensure transfer of the individual sheets from the rotating cylinder assembly 11 to the second conveyor 22.

It should be understood however that the magnetic orientation unit 10 may comprise more than one cylinder, in which case transfer of the sheets from the first conveyor 21 and to the second conveyor 22 may occur through cooperation of the relevant conveyors 21, 22 with additional transfer cylinders.

FIG. 2 further shows that a drying/curing unit 15 is located along the path of the substrate and cooperates with the magnetic orientation unit 10, which drying/curing unit 15 is adapted to dry or cure the ink or varnish vehicle applied on the substrate following orientation of the magnetic or magnetisable flakes. More precisely, the drying/curing unit 15 is located proximate to the outer circumference of the rotating cylinder assembly 11, in the working position WP of the drying/curing unit 15 shown in FIG. 2, at a downstream end of the angular sector AS.

Figure 3:
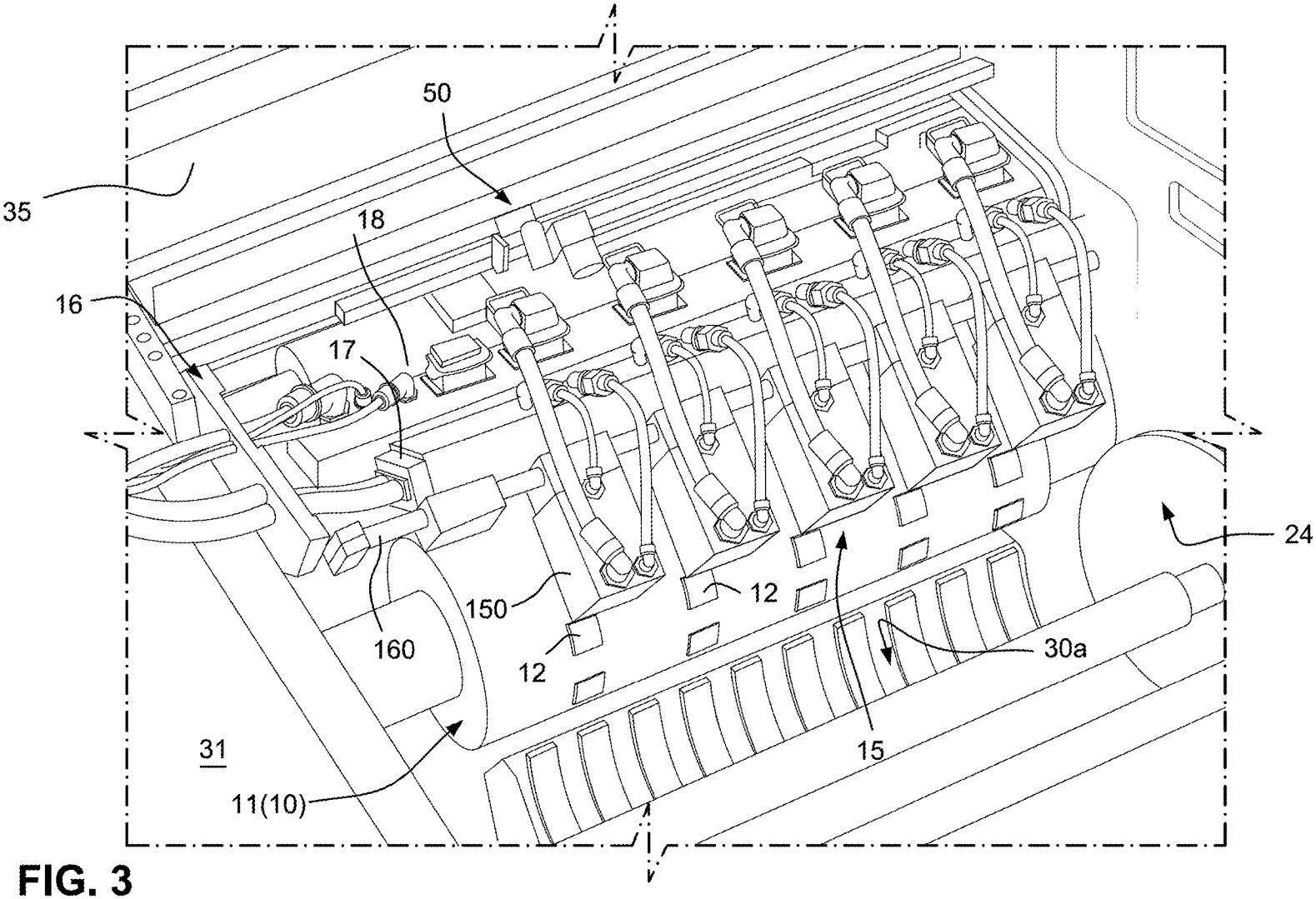
FIG. 3 is a black-and-white photographic illustration of a portion of a printing press embodying the invention as schematically illustrated in the embodiment of FIG. 2.
Figure 4:
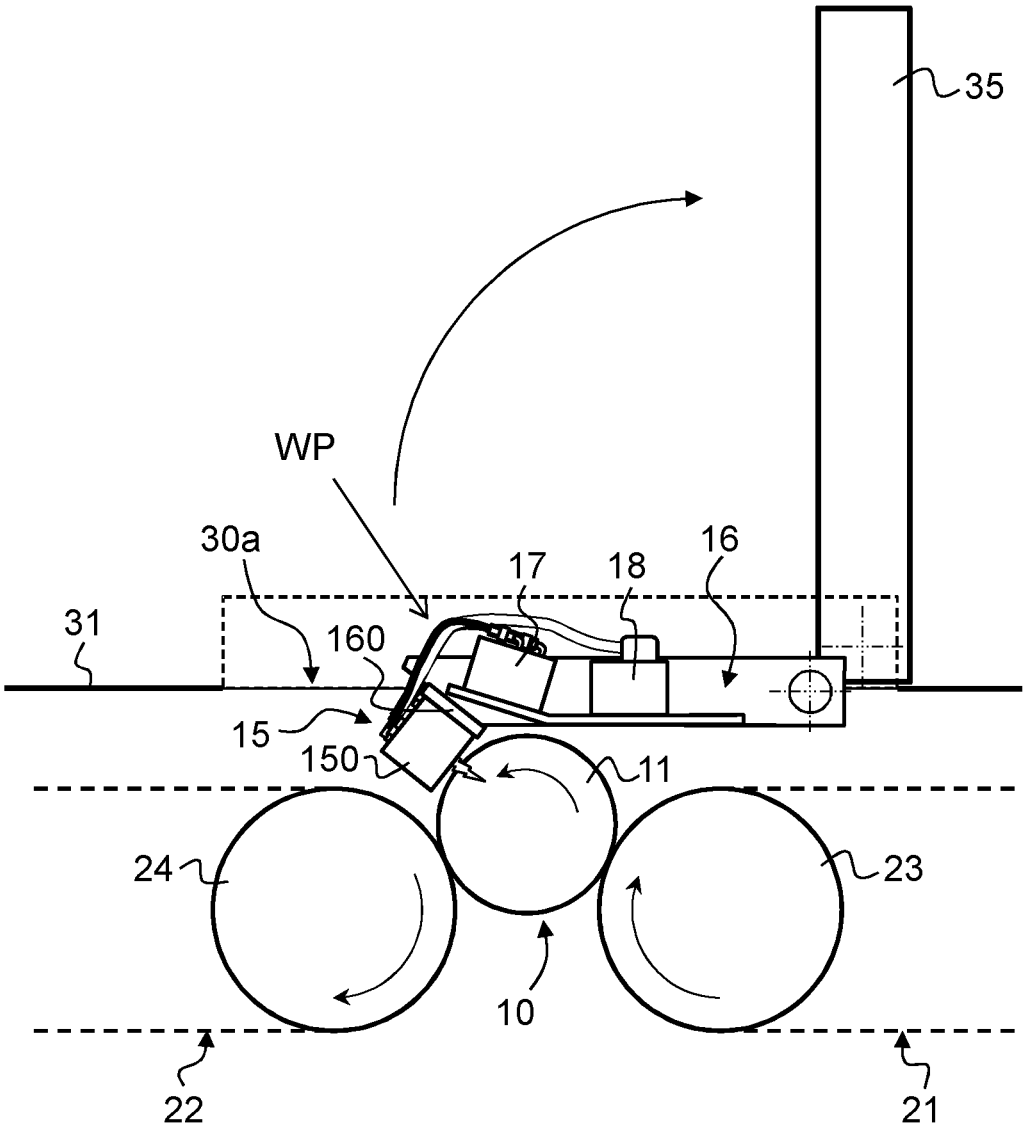
FIG. 4 is a schematic partial side view of the embodiment of FIG. 2 where a removable cover panel is moved to an open position and where a movable supporting structure supporting the drying/curing unit is still in a working position.
Figure 5:
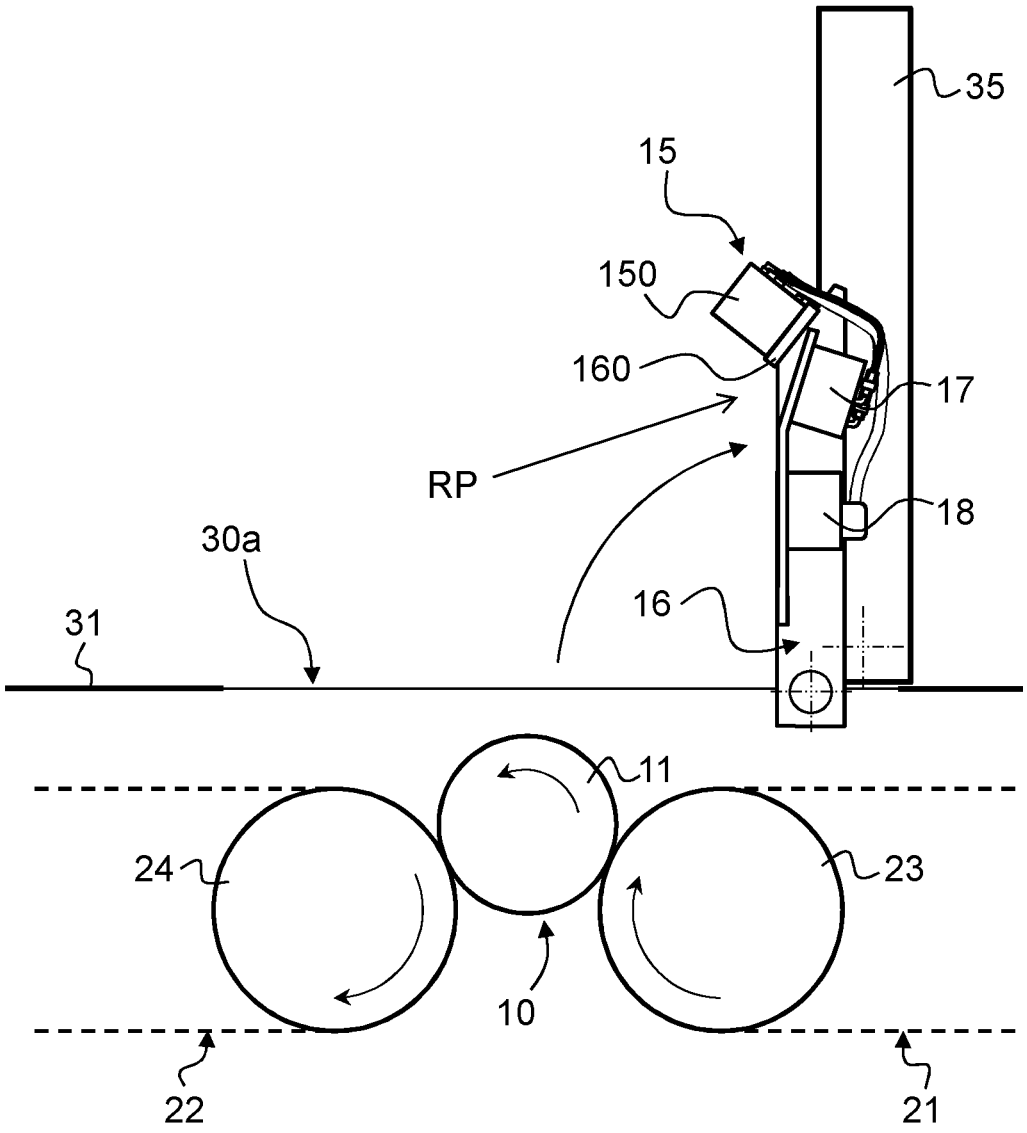
FIG. 5 is a schematic partial side view of the embodiment of FIG. 2 where the movable supporting structure supporting the drying/curing unit is moved to a retracted position, thereby retracting the drying/curing unit away from the magnetic orientation unit and from the path of the substrate, above a floor section of the printing press.
Figure 6:
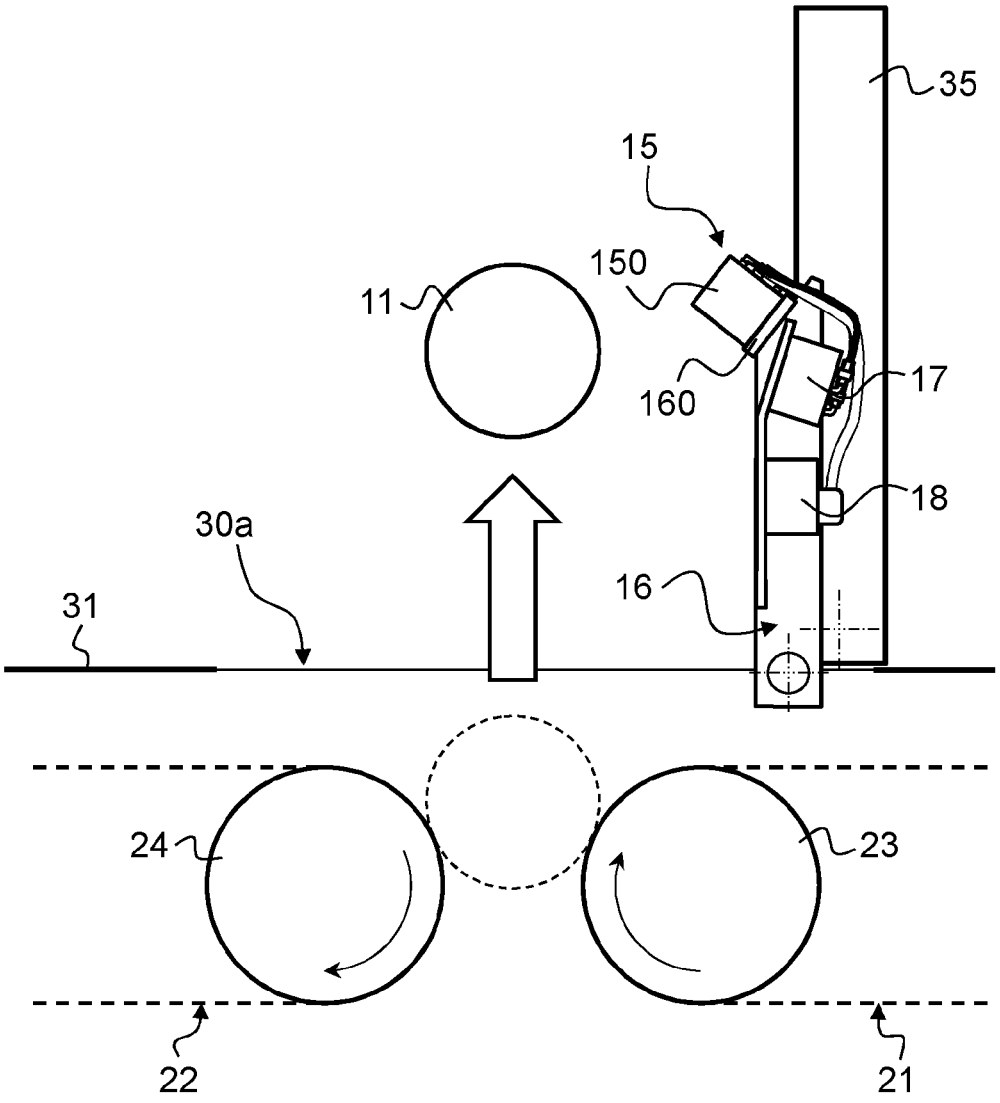
FIG. 6 is a schematic partial side view of the embodiment of FIG. 2 illustrating removal of a rotating cylinder assembly of the magnetic orientation unit, once the drying/curing unit has been moved to the retracted position to free the path for the rotating cylinder assembly.

In accordance with the invention, the drying/curing unit 15 is mounted on a movable supporting structure 16 that is adapted to move the drying/curing unit 15 between a working position WP (as shown in FIGS. 2 to 4), where the drying/curing unit 15 is cooperating with the magnetic orientation unit 10 and is located proximate to the path of the substrate next to the magnetic orientation unit 10, and a retracted position RP (as shown in FIGS. 5 and 6), where the drying/curing unit 15 is retracted away from the magnetic orientation unit 10 and from the path of the substrate.

In the illustrated embodiment, the movable supporting structure 16 is designed as a pivotable arm system, i.e. a system that allows pivoting of the drying/curing unit 15 between the working position WP and the retracted position RP, and vice versa. Movement of the supporting structure 16 between the working position WP and the retracted position RP can be carried out by means of any suitable actuating mechanism, such as a pneumatic system.

Advantageously, as this is schematically illustrated in FIG. 2, the drying/curing unit 15 comprises a plurality of drying/curing heads 150 supported by the movable supporting structure 16 and which are distributed transversally to the path of the substrate (see also FIG. 3 where five such drying/curing heads 150 are provided). Preferably, the drying/curing heads 150 are supported onto a guide rail 160 (extending transversally to the path of the substrates), which guide rail 160 is secured to and movable together with the movable supporting structure 16, a position of each drying/curing head 150 along the guide rail 160 being adjustable.

The rotating cylinder assembly 11 may be similar to the rotating cylinder assembly disclosed in International PCT Publication No. WO 2008/102303 A2. As discussed in WO 2008/102303 A2 and shown in the photographic illustration of FIG. 3, the rotating cylinder assembly 11 typically comprises a plurality of magnetic-field-inducing devices 12, such as permanent magnets, which are distributed about the circumference of the rotating cylinder assembly 11, both in the axial and circumferential directions. These magnetic-field-inducing devices 12 are positioned at locations corresponding to the positions of the relevant patterns of ink or varnish vehicle containing the magnetic or magnetisable flakes that are applied on the substrate, typically in the form of a matrix arrangement corresponding to the typical matrix arrangement of imprints that are conventionally produced in the field of security printing, in particular in the context of the production of banknotes.

In the example shown in FIG. 3, the magnetic-field-inducing devices 12 are arranged in five separate columns about the circumference of the rotating cylinder assembly 11, and the drying/curing unit 15 thus comprises five separate drying/curing heads 150 that are distributed transversally to the path of the substrate at positions corresponding to the columns of magnetic-field-inducing devices 12. The actual number of columns of magnetic-field-inducing devices 12 and the corresponding number of drying/curing heads 150 actually depend on the relevant substrate layout, i.e. on the particular arrangement of imprints being provided on the substrate. As illustrated in FIG. 3, a spare supporting location (here unused) is provided on the left-hand side of the guide rail 160 for the optional mounting of a sixth drying/curing heads 150 should this be necessary.

As schematically illustrated in FIGS. 2 and 3, cooling ports 17 and power supply ports 18 are provided on the supporting structure 16 to ensure suitable cooling and power supply for the individual drying/curing heads 150. The cooling ports 17 are connected to a suitable cooling system, including inter alia a heat exchanger (not shown), that is provided next to the printing press. Likewise, the power supply ports 18 are connected to a suitable power supply system (not shown) provided next to the printing press.

In accordance with the illustrated embodiment of the invention, the rotating cylinder assembly 11 is advantageously removable from the printing press 100, the movable supporting structure 16 being designed to move the drying/ curing unit 15 to the retracted position RP in such a way as to free a path to remove the rotating cylinder assembly 11 from the printing press 100. As schematically illustrated in FIG. 6, the rotating cylinder assembly 11 is preferably removable from the printing press 100 by lifting, e.g. using a suitable lifting crane (not shown).

As shown in FIGS. 2 to 6, the rotating cylinder assembly 11 is conveniently located below a floor section 30 of the printing press 100, the ink or varnish vehicle being applied onto an upper side of the substrate (as indicated by the white triangles in FIG. 2). It will be understood that the rotating cylinder assembly 11 is located below the path of the substrate, under the floor section 30, while the drying/curing unit 15 is located above the path of the substrate. In that respect, the movable supporting structure 16 is suitably designed to move the drying/curing unit 15 from the working position WP, below the floor section 30 (see e.g. FIG. 4), to the retracted position RP, above the floor section 30 (see e.g. FIG. 5). This greatly facilitates access to the drying/curing unit 15 during maintenance operations, for instance for the purpose of exchanging and/or adjusting the position of individual drying/curing heads 150.

As illustrated in FIGS. 2 to 6, the printing press further comprises a removable cover panel 35 that covers the movable supporting structure 16 and the drying/curing unit 15, when the drying/curing unit 15 is in the working position WP. In this position, as illustrated in FIG. 2, the removable cover panel 35 forms a portion of the floor section 30.

This removable cover panel 35 is supported onto a portion 31 of the floor section 30 and designed to be movable with respect to the floor section 30 between a closed position (shown in FIG. 2), where the removable cover panel 35 covers the movable supporting structure 16 and the drying/curing unit 15, when the drying/curing unit 15 is in the working position WP, and forms the portion of the floor section 30, and an open position (shown in FIGS. 3 to 6), where the removable cover panel 35 is moved with respect to the floor section 30 to create an opening 30*a* in the floor section 30 through which the movable supporting structure 16 can be moved. As shown in FIGS. 2 to 6, the portion 31 of the floor section 30 surrounds the opening 30*a*.

While the illustrations of FIGS. 2 to 6 show that the removable cover panel 35 is movable separately from the supporting structure 16, the installation could be modified to ensure that the removable cover panel 35 moves together with the supporting structure 16. Separate movement of the removable cover panel 35 and of the supporting structure 16 is however preferred in that it allows better access to the drying/curing unit 15 (and components thereof) in both the working position WP and the retracted position RP.

The drying/curing unit 15 of the invention is advantageously a UV curing unit, preferably a UV-LED curing unit.

As a possible refinement of the invention, it may be convenient to additionally provide the printing press with a camera to capture live images of the transport of the substrate past the magnetic orientation unit 10. Such a camera, designated by reference numeral 50, is shown in FIG. 3. Such live images may be used to monitor the behaviour of the sheets as they are transported past the magnetic orientation unit 10 and/or for the purpose of performing an inspection of the printed patterns of ink or varnish vehicle and/or of the optically-variable effect induced in the printed patterns.

Various modifications and/or improvements may be made to the above-described embodiments without departing from the scope of the invention as defined by the annexed claims.

In particular, while the embodiments discussed above relate to a silk-screen printing press, the invention is applicable irrespective of the type of printing press and printing process being carried out to apply the at least one ink or varnish vehicle containing magnetic or magnetisable flakes. Silk-screen printing is a preferred printing process in the context of the present invention, but other printing processes could be envisaged, such as intaglio printing or gravure printing.

LIST OF REFERENCE NUMERALS USED THEREIN

100 printing press (especially silk-screen printing press)
1 sheet feeder station
2 (silk-screen) printing group
2*a* impression cylinder
2*b* first (silk-screen) printing unit
2*c* second (silk-screen) printing unit
4 sheet delivery station (including multiple delivery piles)
5 final drying/curing unit (preferred)
10 magnetic orientation unit
11 rotating cylinder assembly of magnetic orientation unit 10
12 magnetic-field-inducing devices carried by rotating cylinder assembly 11
15 drying/curing unit (e.g. UV-LED curing unit) associated to magnetic orientation unit 10
150 individual drying/curing heads of drying/curing unit 15 (e.g. UV-LED curing heads)
16 movable supporting structure supporting the drying/curing unit 15
160 guide rail secured to and movable together with movable supporting structure 16 onto which the individual drying/curing heads 150 are supported (guide rail with integrated power and cooling distribution to power and cool the drying/curing heads 150)
17 cooling ports to which the individual drying/curing heads 150 are coupled for cooling purposes
18 power supply ports to which the individual drying/curing heads 150 are connected to ensure suitable power supply
21 first conveyor system (e.g. chain conveyor system with endless chains driving spaced-apart gripper bars)
22 second conveyor system (e.g. chain conveyor system with endless chains driving spaced-apart gripper bars)
23 pair of chain wheels of first conveyor system 21 (downstream end)
24 pair of chain wheels of second conveyor system 22 (upstream end)
30 floor section of printing press 100 under which is located the rotating cylinder assembly 11
30*a* opening in floor section 30 created when removable cover panel 35 is in an open position and through which the movable supporting structure 16 can be moved
31 part of floor section 30 surrounding opening 30*a*
35 removable cover panel covering the movable supporting structure 16 and the drying/curing unit 15 when the drying/curing unit 15 is in the working position WP (also forms a portion of the floor section 30 when closed)
50 camera to capture live images of the transport of the substrate past the magnetic orientation unit 10 (e.g. camera allowing monitoring of sheet transfer onto rotating cylinder assembly 11)
WP working position of drying/curing unit 15, under the floor section 30 (Figure(s) x)
RP retracted position of drying/curing unit 15, above the floor section 30 (Figure(s) x)

AS angular sector along which the substrate is brought in contact with or in close proximity to the rotating cylinder assembly 11

The invention claimed is:

1. A printing press comprising a printing group adapted to apply on a substrate at least one ink or varnish vehicle containing magnetic or magnetisable flakes and at least one magnetic orientation unit located downstream of the printing group along a path of the substrate, which magnetic orientation unit includes at least one magnetic-field-inducing device adapted to orient the magnetic or magnetisable flakes contained in the ink or varnish vehicle applied on the substrate to induce an optically-variable effect in the ink or varnish vehicle, wherein the printing press further comprises a drying/curing unit located along the path of the substrate and cooperating with the magnetic orientation unit, which drying/curing unit is adapted to dry or cure the ink or varnish vehicle applied on the substrate following orientation of the magnetic or magnetisable flakes, wherein the drying/curing unit is mounted on a movable supporting structure that is adapted to move the drying/curing unit between a working position, where the drying/curing unit is cooperating with the magnetic orientation unit and is located proximate to the path of the substrate next to the magnetic orientation unit, and a retracted position, where the drying/curing unit is retracted away from the magnetic orientation unit and from the path of the substrate.

2. The printing press as defined in claim 1, wherein the magnetic orientation unit comprises a rotating cylinder assembly carrying the said at least one magnetic-field-inducing device on an outer circumference of the rotating cylinder assembly, wherein the substrate is brought in contact to or in close proximity with the rotating cylinder assembly over a defined angular sector, and wherein the drying/curing unit is located proximate to the outer circumference of the rotating cylinder assembly, in the working position of the drying/curing unit, at a downstream end of the angular sector.

3. The printing press as defined in claim 2, further comprising a first conveyor system to convey the substrate from the printing group to the magnetic orientation unit and a second conveyor system to convey the substrate from the magnetic orientation unit onwards.

4. The printing press as defined in claim 3, wherein the printing press is a sheet-fed printing press and wherein the substrate is transferred from the first conveyor system to the magnetic orientation unit and from the magnetic orientation unit to the second conveyor system, the rotating cylinder assembly of the magnetic orientation unit acting as sheet transfer cylinder transporting the substrate over the defined angular sector.

5. The printing press as defined in claim 4, wherein the first and second conveyor systems are chain conveyor systems with endless chains driving a plurality of spaced-apart gripper bars, which gripper bars are designed to hold a leading edge of the substrate.

6. The printing press as defined in claim 2, wherein the rotating cylinder assembly is removable from the printing press and wherein the movable supporting structure is designed to move the drying/curing unit to the retracted position in such a way as to free a path to remove the rotating cylinder assembly from the printing press.

7. The printing press as defined in claim 6, wherein the rotating cylinder assembly is removable from the printing press by lifting.

8. The printing press as defined in claim 2, wherein the rotating cylinder assembly is located below a floor section of the printing press, wherein the ink or varnish vehicle is applied onto an upper side of the substrate, wherein the rotating cylinder assembly is located below the path of the substrate, under the floor section, wherein the drying/curing unit is located above the path of the substrate, and wherein the movable supporting structure is designed to move the drying/curing unit from the working position, below the floor section, to the retracted position, above the floor section.

9. The printing press as defined in claim 8, further comprising a removable cover panel that covers the movable supporting structure and the drying/curing unit, when the drying/curing unit is in the working position, and forms a portion of the floor section.

10. The printing press as defined in claim 9, wherein the removable cover panel is supported onto a portion of the floor section and designed to be movable with respect to the floor section between a closed position, where the removable cover panel covers the movable supporting structure and the drying/curing unit, when the drying/curing unit is in the working position, and forms the portion of the floor section, and an open position, where the removable cover panel is moved with respect to the floor section to create an opening in the floor section through which the movable supporting structure can be moved.

11. The printing press as defined in claim 9, wherein the removable cover panel is movable separately from the movable supporting structure.

12. The printing press as defined in claim 1, wherein the movable supporting structure is designed as a pivotable arm system.

13. The printing press as defined in claim 1, wherein the drying/curing unit is a UV curing unit.

14. The printing press as defined in claim 13, wherein the drying/curing unit is a UV-LED curing unit.

15. The printing press as defined in claim 1, wherein the drying/curing unit comprises a plurality of drying/curing heads supported by the movable supporting structure and which are distributed transversally to the path of the substrate.

16. The printing press as defined in claim 15, wherein the drying/curing heads are supported onto a guide rail, which guide rail is secured to and movable together with the movable supporting structure, and wherein a position of each drying/curing head along the guide rail is adjustable.

17. The printing press as defined in claim 1, wherein the supporting structure further supports cooling and power supply ports to which the drying/curing unit is coupled.

18. The printing press as defined in claim 1, further comprising a camera to capture live images of the transport of the substrate past the magnetic orientation unit.

19. The printing press as defined in claim 1, wherein the printing press is a silk-screen printing press.

* * * * *